United States Patent [19]

Odill et al.

[11] Patent Number: 4,469,467

[45] Date of Patent: Sep. 4, 1984

[54] MANHOLE CHIMNEY SEAL

[75] Inventors: Frank J. Odill, West Allis, Wis.; David E. Anderson, Elk River, Minn.

[73] Assignee: The Cretex Companies, Inc., Elk River, Minn.

[21] Appl. No.: 340,323

[22] Filed: Jan. 18, 1982

[51] Int. Cl.[3] ..... E02D 29/12

[52] U.S. Cl. ..... 404/25; 52/20; 285/226; 285/236; 285/397; 285/109; 277/212 FB; 277/200; 403/50

[58] Field of Search ..... 404/26, 25, 5; 52/19, 52/20, 21; 210/163, 164, 165, 166; 285/236, 226, 397, 370, 109; 137/364, 371; 277/212 FB, 200, 88, 89; 403/50, 51, 134

[56] References Cited

U.S. PATENT DOCUMENTS

| | | | |
|---|---|---|---|
| 1,254,641 | 1/1918 | Adam | 404/25 X |
| 3,294,000 | 12/1966 | Pelsue | 404/25 X |
| 3,490,794 | 1/1970 | Swanson | 285/226 X |
| 3,516,446 | 6/1970 | O'Hargan et al. | 285/109 X |
| 3,813,116 | 5/1974 | Horsley | 285/236 |
| 3,909,412 | 9/1975 | Patry | 210/166 |
| 3,958,313 | 5/1976 | Rossborough | 285/230 |
| 4,059,293 | 11/1977 | Sipler | 285/236 |
| 4,305,679 | 12/1981 | Modi | 404/25 |
| 4,325,572 | 4/1982 | Arntyr et al. | 285/236 X |
| 4,346,922 | 8/1982 | Ohtsuga et al. | 285/109 |
| 4,368,893 | 1/1983 | Gagas | 404/25 X |

FOREIGN PATENT DOCUMENTS

| | | | |
|---|---|---|---|
| 2038976 | 7/1980 | United Kingdom | 285/370 |

*Primary Examiner*—James A. Leppink
*Assistant Examiner*—Beverly E. Hjorth
*Attorney, Agent, or Firm*—Dorsey & Whitney

[57] ABSTRACT

An internal seal is disclosed between a manhole casting and mating manhole components such as concrete adjusting rings, the concrete manhole cone, or masonry structure of a similar configuration, to prevent water infiltration at this interface. The seal is formed by a continuous elastomeric ring. The ring is held in place by two stainless steel retaining bands. The elastomeric ring is pleated to allow an upward movement or lateral movement of the casting without impairing the sealing ability of the ring. The gasket can be installed either during construction or at any time after construction that there is found to be a problem with infiltration.

15 Claims, 7 Drawing Figures

MANHOLE CHIMNEY SEAL

BACKGROUND OF THE INVENTION

The invention relates to manholes, and particularly to that area adjacent the top of the manhole. By spanning the upper portion thereof, it eliminates or reduces surface water infiltration between the manhole casting and the adjacent adjusting rings or components, commonly referred to as the "chimney", which form the upper portion of the manhole and their interface with the manhole casting.

A manhole casting may sit directly on a manhole cone or there may be adjusting rings between the cone and the casting. Existing manhole chimneys have also had the casting shimmed with wood or bricks, with mortar placed in the gaps in between. Manhole chimneys of the past have been constructed with precast adjusting rings or of brick or block and are used on manholes constructed with precast sections, brick or block, or cast in place concrete.

Most inventive activity relating to the subject matter of the invention has been directed to sealing pipe sections and sealing pipes to manholes at the bottom of a manhole to prevent water infiltration at lower levels of the manhole. However, after the pipes have been sealed to the bottom of the manhole, and the manhole constructed and backfilled to approximately the level of the top of the casting, surface water infiltration between the casting and manhole chimney has been possible. This is a problem leading to increased sewage treatment costs, uncomfortable working conditions, and other problems inherent when unanticipated fluids leaked into existing manhole structures.

Two prior patents have been issued which relate to improvements to the placing of manhole castings. U.S. Pat. No. 3,308,727 provides a cushion for a manhole cover but does not seal it. U.S. Pat. No. 4,029,425 provides an extension for a manhole. With the latter invention a seal of the extension can be provided in the form of a bicycle tire innertube which can be inflated after the extension is in place which should prevent infiltration at the level of the bicycle innertube.

SUMMARY OF THE INVENTION

Applicant's invention is intended to prevent water inflow into a previously or newly constructed manhole throughout the upper courses of the adjustment rings, as well as the interface with the manhole casting, while also providing flexibility to allow for the movement of this casting due to frost action, shifting ground conditions, traffic loadings, and the like. The seal is designed to provide flexibility in movement in both the axial (vertical) and transverse (horizontal) directions or any combination of the two within design limits. The seal is designed to be installed into a completed, backfilled manhole. It is fastened to the inside of both surfaces (manhole casting and manhole chimney). The sealing bands used and disclosed in connection with the seal have the ability to be expanded inside varying casting and chimney diameters.

The resulting chimney seal provides an effective means to totally eliminate or substantially reduce surface water infiltration between the manhole casting and the adjacent components which form the upper portion of the manhole, thus eliminating or reducing the amount of surface runoff that must be treated along with the sewage, providing a dry and suitable working environment for workmen who must descend into the manhole in the course of their employment, and solving similar problems related to unexpected infiltration of water in a manhole.

These and other features, advantages and objectives of the invention will become apparent from a consideration of the following description in connection with the drawings.

DESCRIPTION OF THE DRAWINGS

FIG. 3, consisting of FIGS. 3*a*–3*e*, disclose the elements of a preferred embodiment of one of the stainless steel retaining bands.

DESCRIPTION OF THE PREFERRED EMBODIMENT

Figure 1:
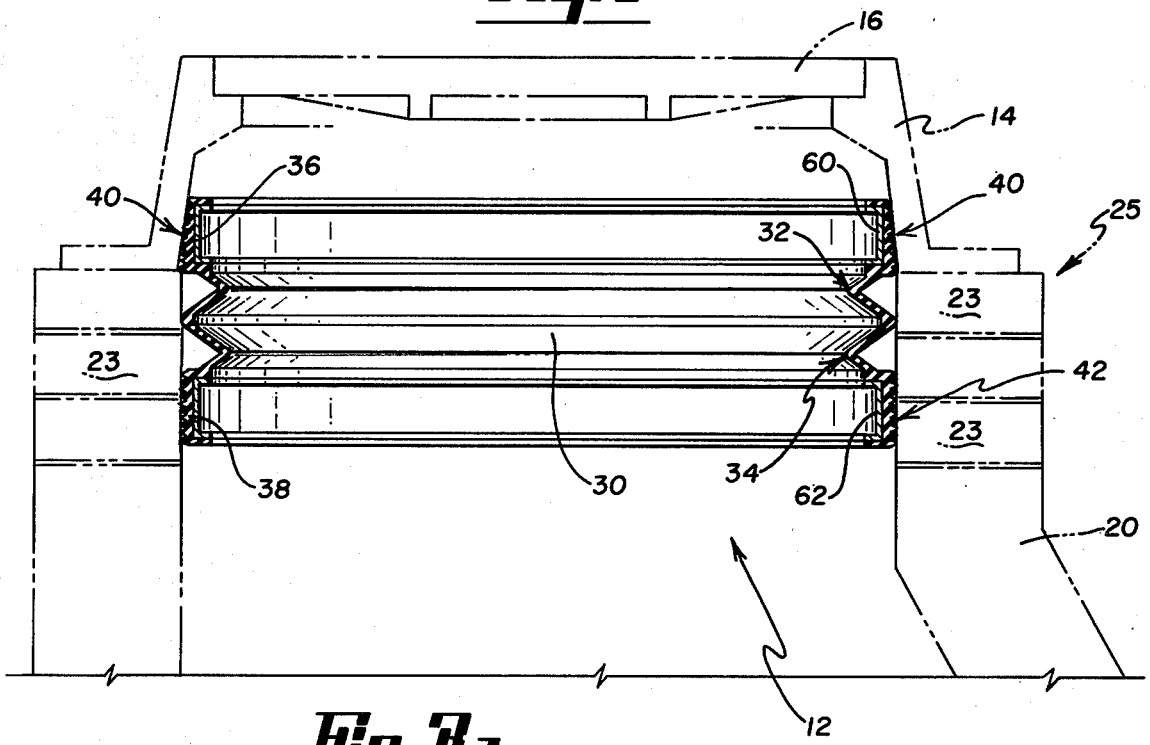
FIG. 1 is an elevational cross section of a manhole casting, chimney, and riser showing how the pleated seal of the instant invention is positioned to seal the manhole casting to the riser.
Figure 3A:
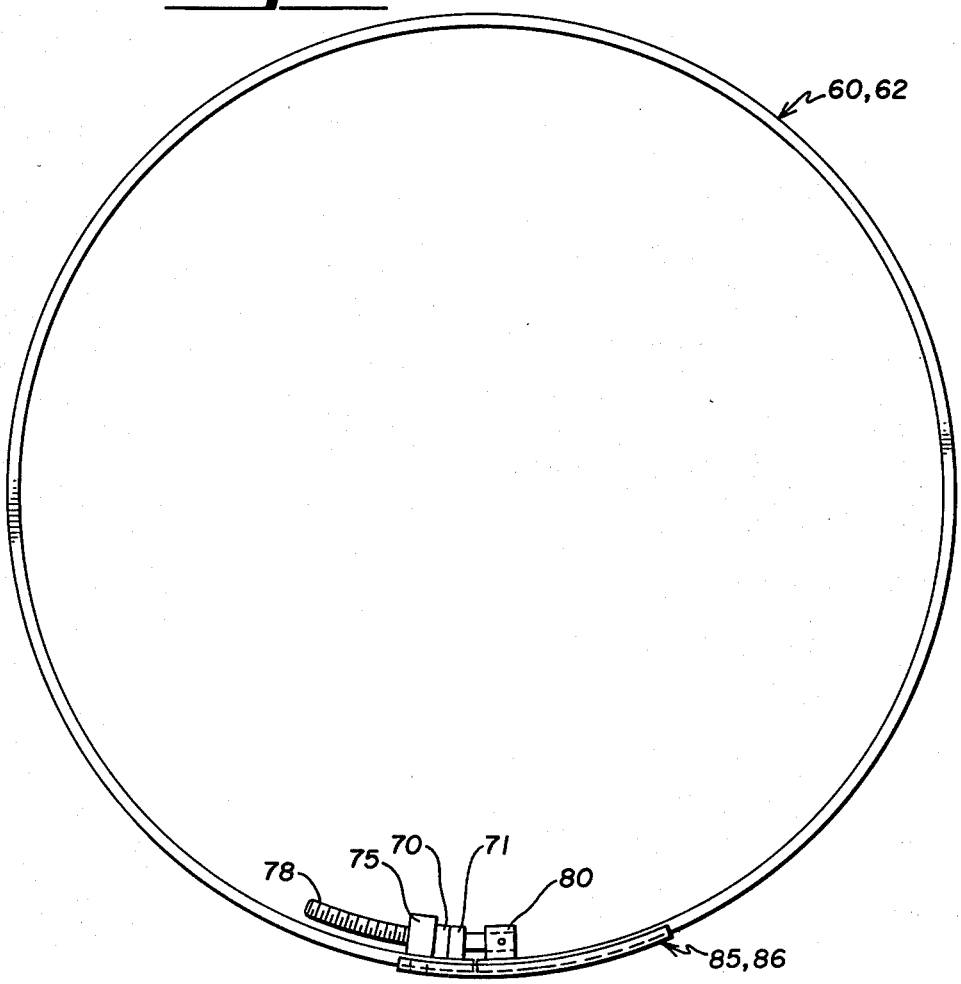
FIG. 3*a* shows the band and the means for expanding it.

The preferred embodiment of the manhole chimney seal 12 is shown in FIG. 1 sealing the manhole casting 14, which receives the manhole cover 16, to the manhole chimney 25, spanning portions of the adjusting rings 23 or cone 20. The seal 12 functions to eliminate or substantially reduce surface water infiltration between the manhole casting 14 and the adjacent chimney components 25 which form the upper portion of the manhole. The manhole casting 14 may sit directly on a manhole cone 20 or there may be chimney components 25, as shown in FIG. 1 between the cone 20 and casting 14. Existing manhole chimneys 25 may be made entirely of block or brick and may have also had the casting 14 shimmed with wood or bricks with mortar placed in the gap in between. The present invention effectively seals such a structure as well.

The primary function of the invention is to seal between the casting 14 and the first "sound" section of the manhole chimney 23 or cone 20. This may be the level directly beneath the manhole casting 14 or it may mean spanning some of the chimney area 25 as may be the case in manholes that have been shimmed and mortared.

Figure 2:
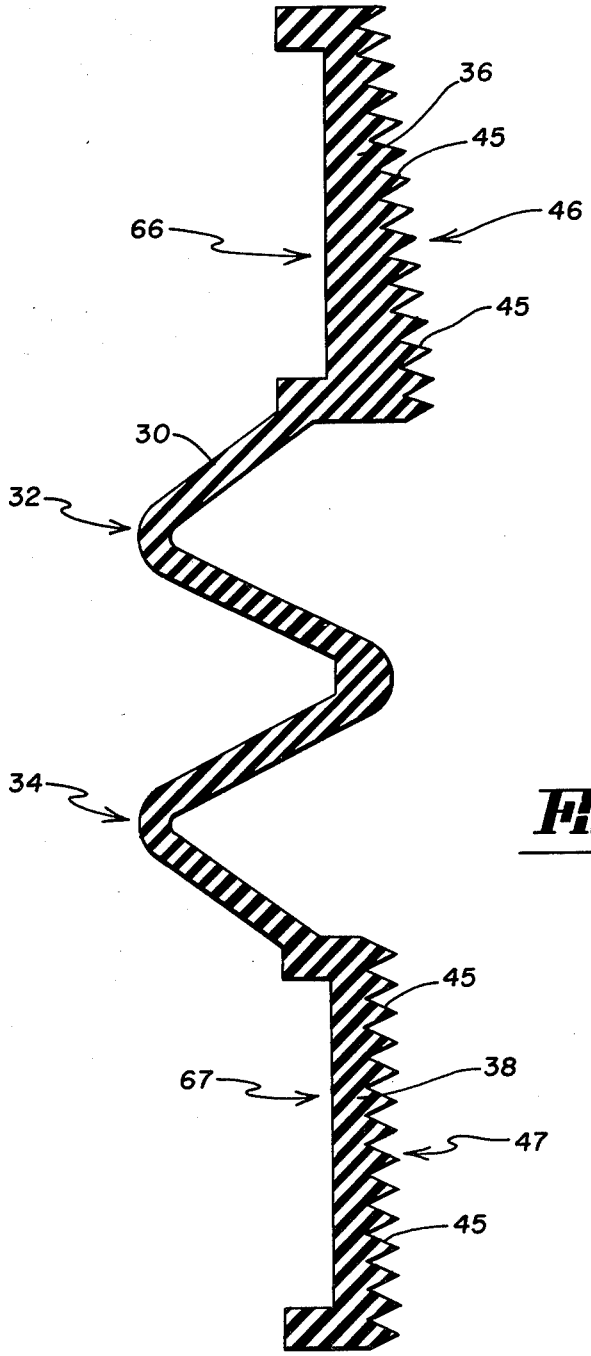
FIG. 2 is a cross section of the pleated elastomeric ring.

The seal 12 itself consists of an extruded and spliced rubber section 30 as shown in FIG. 2 which is cut to the propr length and vulcanized to form the generally cylindrical shape. It 30 can be constructed of either a neoprene or polyisoprene rubber compound, or other rubber type material. As shown in FIGS. 1 and 2 it consists of two center pleats 32, 34, with sealing sections 36, 38, at either end. A flat section (not shown) between the two center pleats 32, 34, may be employed to span larger sections of the chimney.

The pleats 32, 34, allow for vertical and horizontal movement of the casting 14 without disturbing the watertightness of the seal 12. This permits flexibility to allow for the movement of the casting 14 due to frost action, shifting ground conditions, traffic loadings, and the like. The pleats 32, 34, also allow for installation of the seal 12 with a certain amount of vertical gap between the manhole casting 14 and the chimney 25 as well as horizontal misalignment of the casting 14 and chimney 25 and/or cone 20.

The sealing section 36 that is to fit in the manhole casting 14 is preferably tapered to fit the taper of the casting 14. A one to eight slope has been found satisfactory. Both sealing sections 36, 38, are fastened to the inside of both sealing surfaces 40, 42, and may have fins 45 formed on the sealing side 46, 47 to allow a certain degree of composition to fill irregularities in the sealing surface 40, 42. The inside of each sealing section 46, 47, is apertured 66, 67, to hold the retaining bands 60, 62, in place.

The two stainless steel retaining bands 60, 62, hold the seal 12 in place. The bands 60, 62, are expanded by turning a hex nut 70 against a slotted lug 75 which receives a bolt 78 to expand the band 60, 62. The band 60, 62, is infinitely adjustable over the length of the bolt 78. A second hex nut 71 is used to lock the assembly after final tightening of retaining bands 60, 62.

As shown most clearly in FIG. 3, each U-shaped stainless steel retaining band 60, 62, which can be constructed of sixteen gauge steel, is of a dimension to fit within the receiving apertures 66, 67, in the sealing sections 46, 47. A stainless steel block 80, shown in FIG. 3*c*, is drilled and tapped to receive a threaded rod 78 which is held in the block 80 with a roll pin (not shown) inserted through an appropriate aperture 81. Three holes 82–84 are drilled and tapped in the bottom of the block 80 so that the block 80 can be secured to the retaining band 60, 62.

Figure 3B:
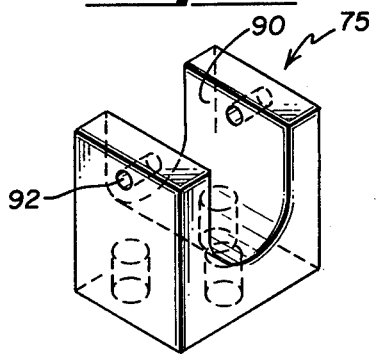
FIGS. 3*b* and 3*c* show the stainless steel blocks used to maintain the band at the necessary expansion.
Figure 3C:
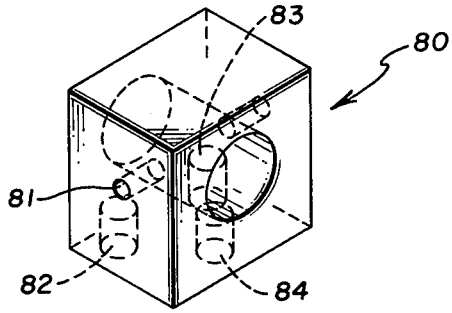
Figure 3D:
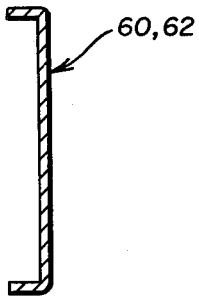
FIGS. 3*d* and 3*e* show the cross sectional dimensions of the retaining band and lap band which is used, as shown in FIG. 3*a*, to maintain the expansion of the retaining band to the required diameter.
Figure 3E:
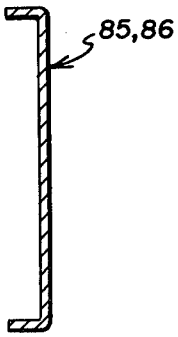

A short lap band 85, 86, shown in FIG. 3*e*, of a slightly larger dimension than retaining band 60, 62, but adapted to be received in the apertures 66, 67, in the sealing sections 46, 47, is provided which overlaps the retaining band 60, 62. Attached to both the retaining band 60, 62, and the lap band 85, 86, is a second stainless steel block 75 shown in FIG. 3*b* which is slotted 90 to receive the threaded bolt or rod 78. An aperture 92 for receiving a roll pin (not shown) can be provided in the slotted block or lug 75 to contain the threaded rod 78 therein.

The threaded rod 78 can be slightly bent to conform to the circumference of the expanded retaining ring 60, 62, and interposed between the lugs 75, 80, are the hex jam nuts 70, 71, threaded on the rod 78.

Expansion is thus accomplished tangentially by rotation of the hex nut 70 against the second block 75 which forces the first block 80 to increase the effective circumference of the retaining band 60, 62, until the sealing sections 46, 47, are securely seated on the sealing surfaces 40, 42, to effect the seal. Hex nut 71 is used to lock the assembly in place.

Further field adjustment of the retaining bands is possible by moving the slotted lug 75 to predrilled holes farther back on the retaining band 60, 62, and cutting off the excess band. If necessary, additional sets of holes can be field-drilled for more exact adjustment. Both the band 60, 62, and the gasket 30 can be manufactured to specific sizes to fit different size manholes as specified in certain localized codes.

From a consideration of the foregoing disclosure it should be obvious that the invention is a simply constructed and economically manufactured seal which overcomes problems presently existing in the subject matter to which the invention relates. While a specific preferred embodiment has been disclosed in detail, it should be obvious to those skilled in the art that differently shaped or configured sealing means can be utilized in a similar manner to achieve the objectives of the invention. For example, expansion of the retaining rings in the apertures in the sealing section can be achieved with other means well-known to those skilled in the art. It should be understood that such modifications and variations may be resorted to without departing from the spirit of the invention and that such modifications and variations are considered to be within the purview and scope of the present invention as defined by the following claims.

Having described our invention, we claim:

1. A manhole seal for manhole assemblies of varying diameters having a manhole casting mounted on the manhole, the improvement comprising:

sealing means for sealing the interface between the manhole casting and the manhole against infiltration of surface water without preventing ingress or egress to the manhole, the sealing means comprising:

a generally cylindrical axially expandable rubber seal having sealing sections on each end thereof, the sealing section on one end thereof being adapted to be sealed to the inside surface of the manhole and the sealing section on the other end thereof being adapted to be sealed to the inside surface of the manhole casting;

a retaining band associated with each of the sealing sections, both retaining bands having two end which overlap one another and when connected together form a continuous circular retaining band, each retaining band being adapted to extend around the periphery of the manhole assembly without obstructing ingress or egress thereto and to force the sealing section against the surface to be sealed;

each sealing section having an aperture therein to receive the circular retaining bands;

means for tangentially expanding each of the retaining bands to the diameter necessary to seal the sealing section against the surface to be sealed so that a continuous force is provided around the circumference of each sealing section to seal each of the sealing sections against the respective surfaces being sealed said means for tangentially expanding at least one of the bands comprising at least one aperture at each end of the band; and means for locking each of the expanded retaining bands so that the sealing means seals the interface between the manhole casting and the manhole against infiltration of surface water said means for locking at least one of the bands comprising at least one fastening means which extends through the aperture at each end of the band to lock the band after it has been expanded.

2. The improvement of claim 1 wherein at least each end of the circular retaining band has radially inward extending flanges; wherein one end of at least one of the circular retaining bands has a narrower lateral dimension than the other end so that the ends of the band overlap to form the continuous circular retaining band.

3. The improvement of claim 1 wherein the manhole comprises a manhole chimney upon which the manhole casting is mounted and wherein the sealing section on one end thereof is adapted to be sealed against a surface of the manhole casting and the sealing section on the other end thereof is adapted to be sealed to a surface of the manhole chimney.

4. The improvement of claim 1 wherein the rubber seal further comprises:

an intervening section to span the vertical distance between the manhole casting and the manhole; and wherein the intervening section is pleated to allow for vertical and horizontal movement of the manhole cover casting relative to the manhole.

5. The improvement of claim 4 wherein the rubber seal is formed from an extruded and spliced rubber section cut to the proper length and vulcanized to form the generally cylindrical shaped rubber seal and wherein at least two center pleats are formed in the intervening section of the seal.

6. The improvement of claim 1 wherein each sealing section has a plurality of fins formed on the sealing surface thereof for filling irregularities in the surface against which it is compressed.

7. The improvement of claim 1 wherein the means for expanding each retaining band comprises:

a lap band associated with each retaining band which overlays the retaining band;

a first fastening means connected to the retaining band;

a second fastening means connected to both the retaining band and the lap band; and expansion means interposed between the fastening means.

8. The improvement of claim 7 wherein each associated retaining band and lap band has a U-shaped cross section and is dimensioned so that one band fits within the other.

9. The improvement of claim 8 wherein the lap band has a slightly larger transverse dimension than the associated retaining band.

10. The improvement of claim 7 wherein the first fastening means comprises a stainless steel block attached to the retaining band; the expansion means comprises a threaded rod fixedly secured to the first fastening means and at least one internally threaded and rotatable nut threaded on the threaded rod; the second fastening means comprises a lug fixedly secured to the lap band and with an aperture therein to receive the threaded rod; and wherein the retaining band is tangentially expanded by rotating the nut threaded on the rod against the second fastening means to force the retaining band apart within the lap band.

11. The improvement of claim 10 wherein the threaded rod is slightly bent to conform to the circumference of the expanded retaining ring.

12. The improvement of claim 1 wherein at least one of the sealing sections is tapered to fit the taper of the surface to which it is sealed.

13. The improvement of claim 1 wherein the sealing section of the rubber seal which is to be sealed to the inside surface of the manhole casting is tapered to fit the taper of the manhole casting.

14. The improvement of claim 13 wherein the upper sealing section is tapered to have a one to eight slope.

15. The improvement of claim 1 wherein the manhole comprises a manhole cone on which the manhole casting is mounted and wherein the sealing means is pleated so that the sealing means may be sealed to a surface of the cone and a surface of the manhole casting and span the area between them.

* * * * *

UNITED STATES PATENT AND TRADEMARK OFFICE

CERTIFICATE OF CORRECTION

PATENT NO. : 4,469,467

DATED : September 4, 1984

INVENTOR(S) : Frank J. Odill and David E. Anderson

It is certified that error appears in the above-identified patent and that said Letters Patent is hereby corrected as shown below:

In column 2, line 55, insert "e" between the p & r in propr

In column 3, line 11, delete "composition" and insert --compression--

In column 4, line 31, add an "s" to the word --end--

Signed and Sealed this

*Twelfth* Day of *March 1985*

[SEAL]

*Attest:*

DONALD J. QUIGG

*Attesting Officer*

*Acting Commissioner of Patents and Trademarks*